US005186659A

United States Patent [19]

Hefner

[11] Patent Number: 5,186,659

[45] Date of Patent: Feb. 16, 1993

[54] LIGHT BULB ADAPTER APPARATUS

[76] Inventor: George F. Hefner, 1611 N. Sugar St., Lima, Ohio 45801

[21] Appl. No.: 791,357

[22] Filed: Nov. 14, 1991

[51] Int. Cl.[5] ..... H01R 27/02

[52] U.S. Cl. ..... 439/643; 439/639

[58] Field of Search ..... 439/638, 641-643, 439/648, 236, 701-707, 639, 640; 313/318

[56] References Cited

U.S. PATENT DOCUMENTS

| | | | |
|---|---|---|---|
| 762,535 | 6/1904 | Kelsey | 439/643 |
| 3,489,991 | 1/1970 | Hilzen | 439/641 |
| 4,407,560 | 10/1983 | Williams | 439/642 |
| 4,440,467 | 4/1984 | Vologni et al. | 439/642 |
| 4,783,726 | 11/1988 | Wang | 439/642 |

*Primary Examiner*—David L. Pirlot
*Attorney, Agent, or Firm*—Leon Gilden

[57] ABSTRACT

An adapter structure includes a central socket formed with a lower body arranged for threaded engagement with a conventional first socket, and includes a unitary body formed with a polymeric upper housing coaxially aligned with a second socket, with the upper housing including an abutment flange for limiting projection into the first socket. The invention may further be arranged to include a plurality of radially projecting further socket members, each adjustably mounted utilizing telescoping legs to effect electrical communication and junction between the further socket members and the first and second sockets.

2 Claims, 5 Drawing Sheets

LIGHT BULB ADAPTER APPARATUS

BACKGROUND OF THE INVENTION

1. Field of the Invention

The field of invention relates to light bulb adapter apparatus, and more particularly pertains to a new and improved light bulb adapter apparatus wherein the same is arranged for the adaption of a light bulb of a secondary size relative to a socket of a varying first size.

2. Description of the Prior Art

Typically, socket members are formed of a standardized size for accommodation of light bulbs, wherein various ornamental type light bulbs such as utilized in the seasonal basis, such as Christmas lights, are formed of a differing threaded base for reception within a diminished socket size. The instant invention attempts to overcome deficiencies of the prior art by providing for an adapter socket permitting the adaption of diminished size light bulb bases within standardized sockets.

Various socket adapters of various types utilized in the prior art to accommodate various specialized situations are exemplified in U.S. Pat. No. 4,888,678 to Sundhar wherein light bulbs in 110 volt or with 220 volt circuits are accommodated.

U.S. Pat. No. 4,645,283 to MacDonald, et al. sets forth an adapter for mounting a fluorescent lamp in an incandescent type socket.

Accordingly, it may be appreciated that there continues to be a need for a new and improved light bulb adapter apparatus as set forth by the instant invention which addresses both the problems of ease pf use as well as effectiveness in construction and in this respect, the present invention substantially fulfills this need.

SUMMARY OF THE INVENTION

In view of the foregoing disadvantages inherent in the known types of light bulb adapter apparatus now present in the prior art, the present invention provides a light bulb adapter apparatus wherein the same permits the reception of a secondarily sized light bulb base into electrical communication with a socket of a primary size base. As such, the general purpose of the present invention, which will be described subsequently in greater detail, is to provide a new and improved light bulb adapter apparatus which has all the advantages of the prior art light bulb adapter apparatus and none of the disadvantages.

To attain this, the present invention provides an adapter structure including a central socket formed with a lower body arranged for threaded engagement with a conventional first socket, and includes a unitary body formed with a polymeric upper housing coaxially aligned with a second socket, with the upper housing including an abutment flange for limiting projection into the first socket. The invention may further be arranged to include a plurality of radially projecting further socket members, each adjustably mounted utilizing telescoping legs to effect electrical communication and junction between the further socket members and the first and second sockets.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved light bulb adapter apparatus which has all the advantages of the prior art light bulb adapter apparatus and none of the disadvantages.

It is another object of the present invention to provide a new and improved light bulb adapter apparatus which may be easily and efficiently manufactured and marketed.

It is a further object of the present invention to provide a new and improved light bulb adapter apparatus which is of a durable and reliable construction.

An even further object of the present invention is to provide a new and improved light bulb adapter apparatus which is susceptible of a low cost of manufacture with regard to both materials and labor, and which accordingly is then susceptible of low prices of sale to the consuming public, thereby making such light bulb adapter apparatus economically available to the buying public.

Still yet another object of the present invention is to provide a new and improved light bulb adapter apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
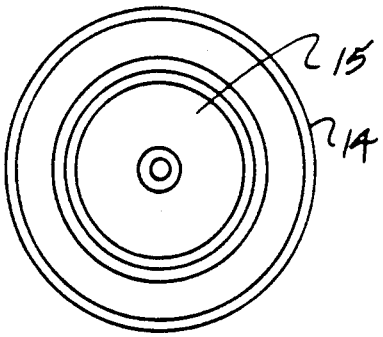
FIG. 2 is an orthographic top view of the instant invention.

With reference now to the drawings, and in particular to FIGS. 1 to 7 thereof, a new and improved light bulb adapter apparatus embodying the principles and concepts of the present invention and generally designed by the reference numeral 10 will be described.

Figure 1:
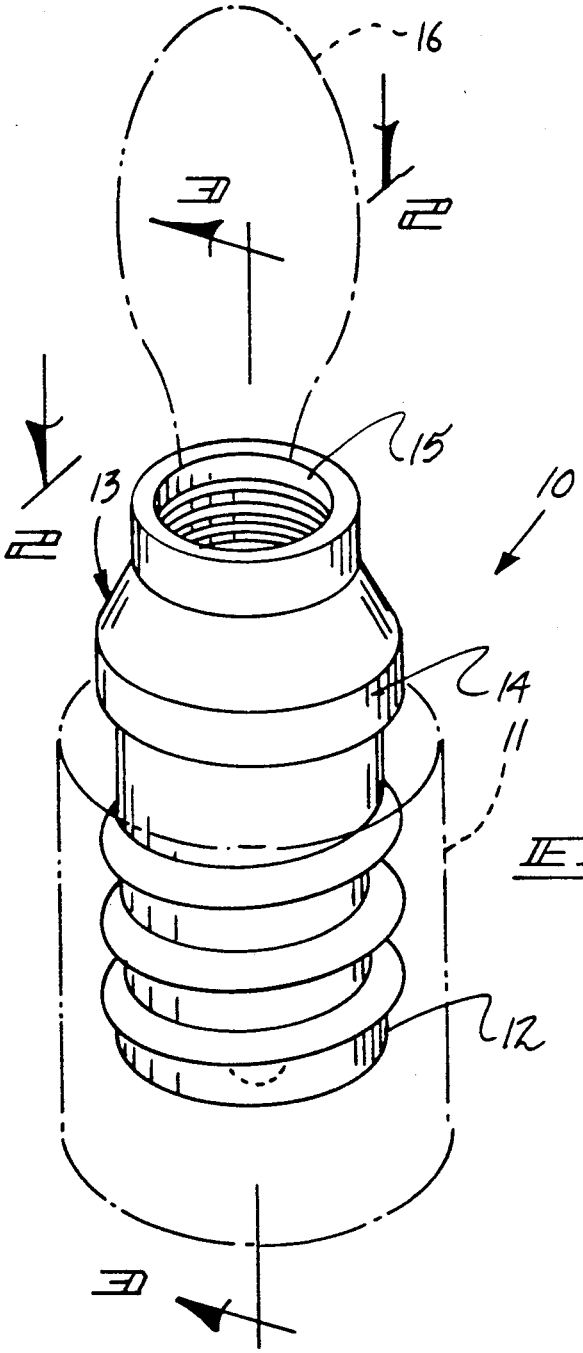
FIG. 1 is an isometric illustration of the instant invention.
Figure 3:
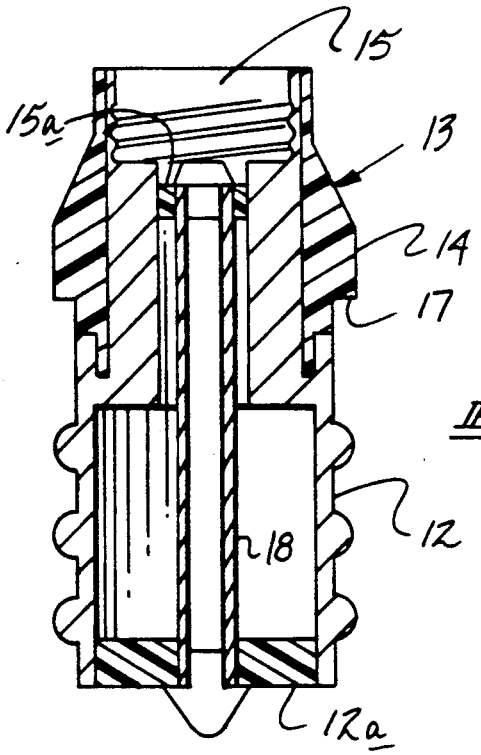
FIG. 3 is an orthographic view, taken along the lines 3—3 of FIG. 1 in the direction indicated by the arrows.
Figure 4:
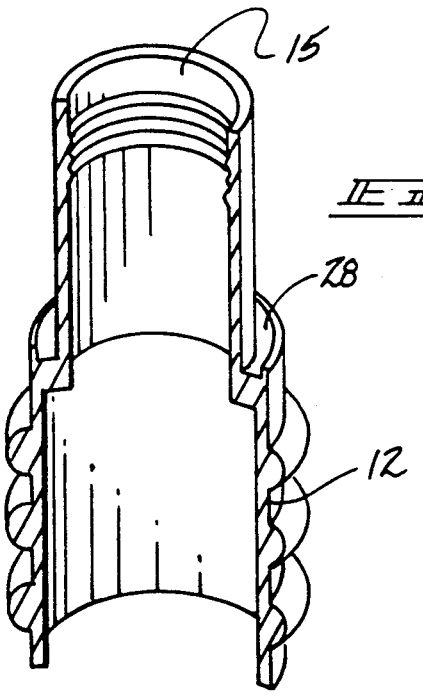
FIG. 4 is an isometric cross-sectional illustration of the invention.

More specifically, the light bulb adapter apparatus 10 of the instant invention essentially comprises the apparatus 10 arranged for use in combination with a standard light bulb socket 11 formed with an internally threaded first bore of a first diameter, such as illustrated in FIG. 1. The adapter apparatus 10 includes an adapter externally threaded cylindrical base 12 complementarily received within the first bore and defined by a diameter equal to the first diameter. The adapter 12 further includes a head 13 integrally secured relative to the base 12 and to an adapter internally threaded socket 15 that is arranged coaxially relative to the base 12, with a socket 15 formed by a second diameter less than the first diameter to receive a light bulb member 16 of a diminished base size. The adapter head 13 includes an adapter head flange 14 extending radially beyond the upper terminal end of the base 12 for abutment of an upper terminal end of the standard light bulb socket 11. An abutment surface 17 of a generally torroidal configuration is arranged for abutment with the upper terminal end of the standard light bulb socket 11, with the abutment surface 17 illustrated for use in the FIG. 3. A central inner conductor rod 18 is coaxially mounted relative to the cylindrical base 12 and the socket 15 and extends from the base bottom wall 12*a* coaxially of the base and the socket 15 to extend through the adapter head floor 15*a* projecting into the adapter internally threaded socket 15. As illustrated, the base 12 and the socket 15 are of a unitary integral construction formed coaxially relative to one another, with the adapter head 13 formed as a polymeric material for insulative purpose extending from an upper terminal end of the socket 15, to include a cylindrical skirt received within a body groove 28 formed at an upper terminal end of the base 12. In this manner, electrical communication from the standard socket 11 is directed about the base 12 into the socket 15 and the annular wall socket 15, with the central inner conductor rod 18 forming electrical communication between axially aligned terminals of the socket 11 of conventional construction and the internally threaded socket 15.

Figure 5:
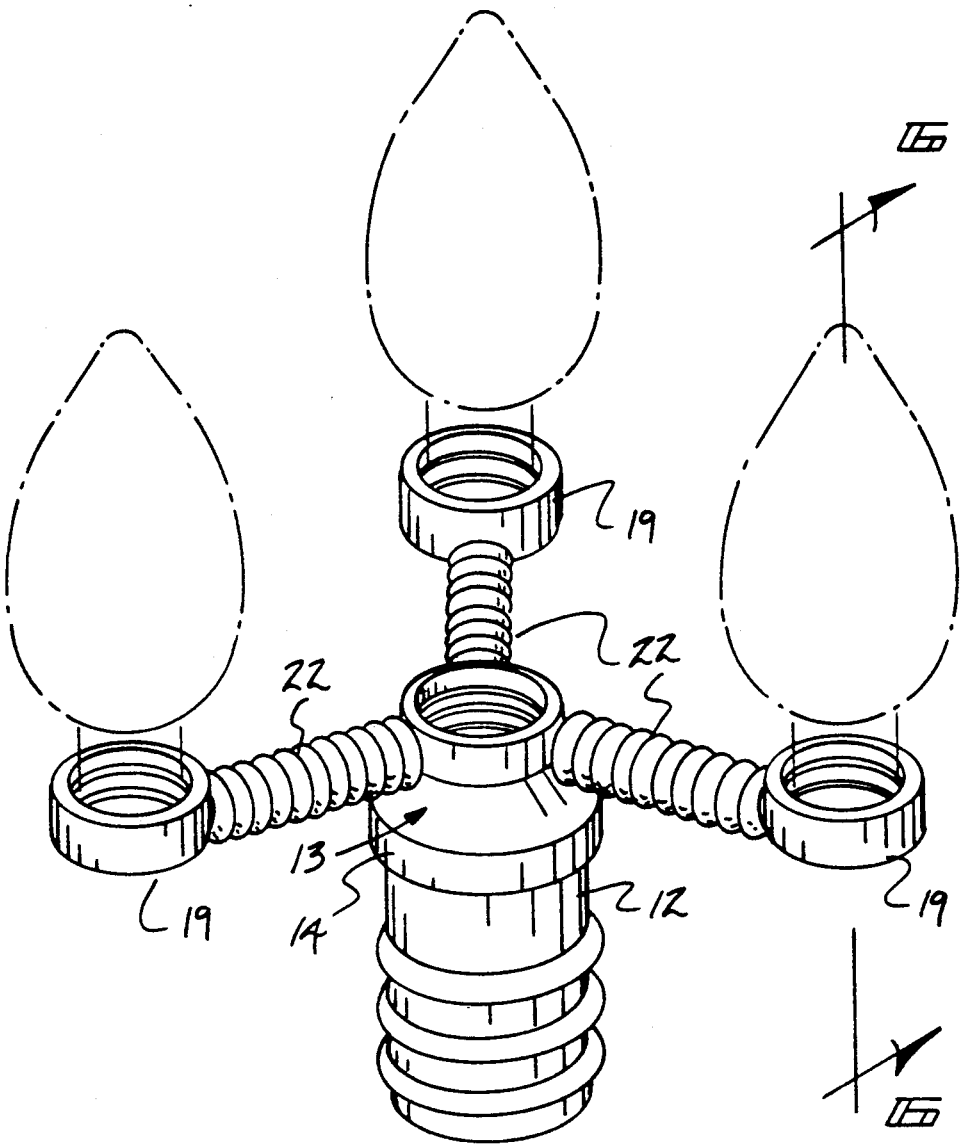
FIG. 5 is an isometric illustration of a modification of the invention.
Figure 6:
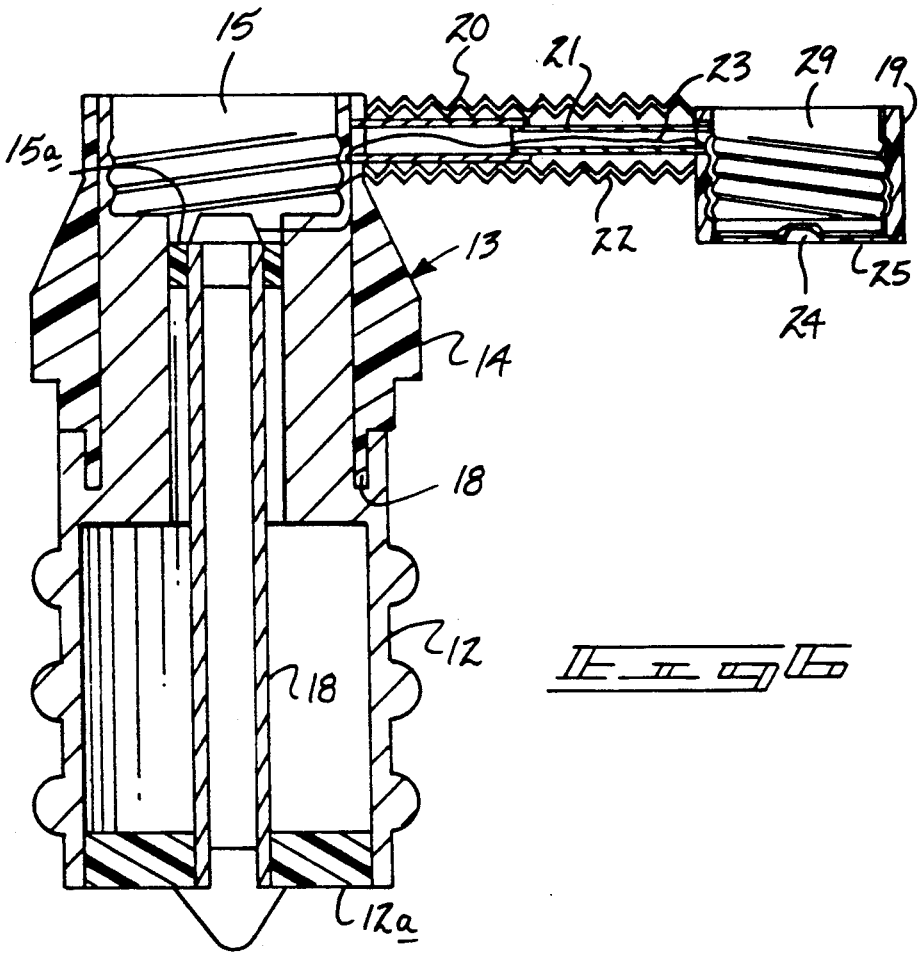
FIG. 6 is an orthographic view, taken along the lines 6—6 of FIG. 5 in the direction indicated by the arrows.
Figure 7:
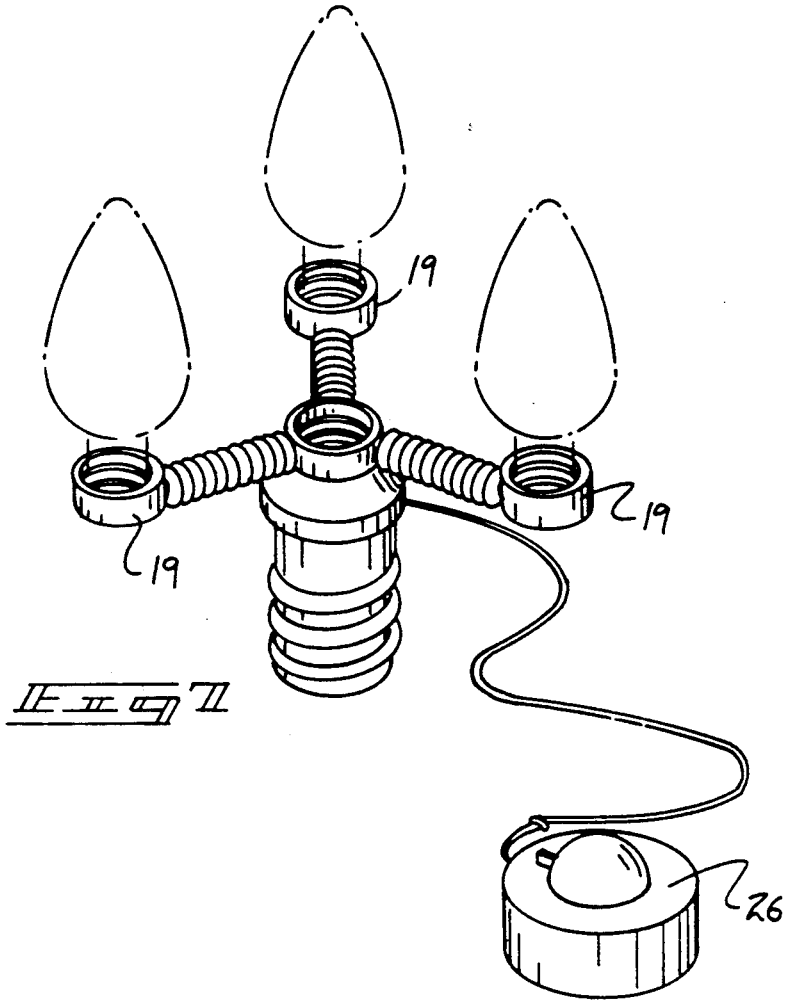
FIG. 7 ia an isometric illustration of the invention utilizing a switch member to effect selective actuation of the component further socket members positioned radially and exteriorly of the primary adapter socket.
Figure 8:
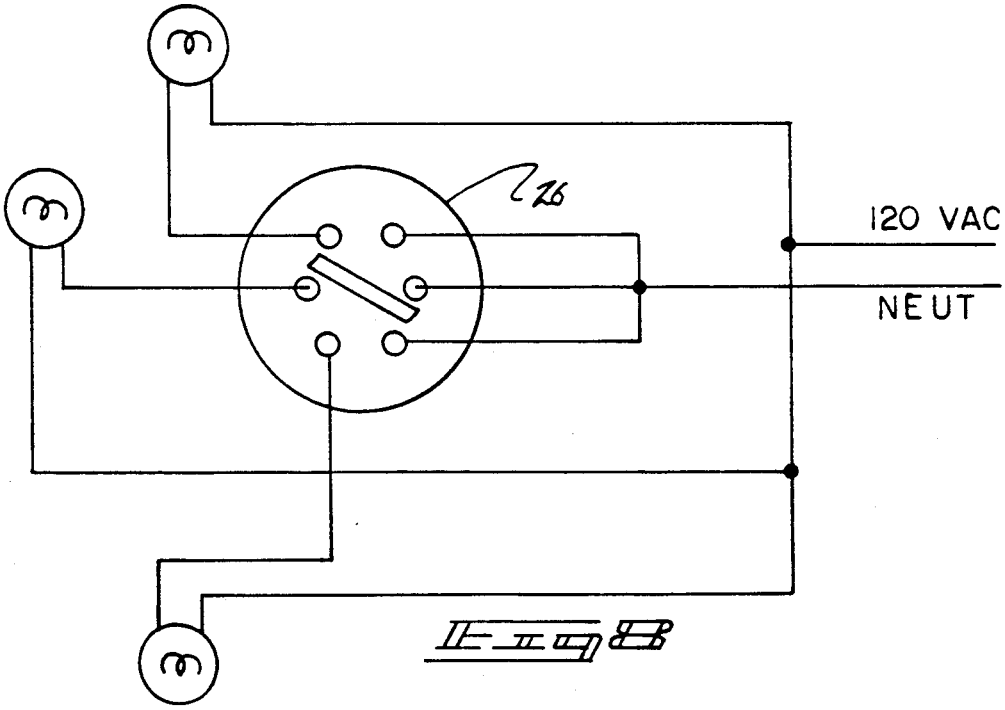
FIG. 8 is a typical diagramatic illustration of the switch member in use.

The FIG. 5 illustrates the use of further socket members 19 arranged for electrical communication with the adapter internally threaded socket 15 and the base 12. Each further socket includes an outer socket floor coaxially mounting an outer socket post 24. The outer socket post 24 includes electrical connector wire 23 in electrical communication with the central inner conductor rod 18, wherein the electrical connector wire 23 is directed through a respective first and second metallic mounting tube 20 and 21, wherein the second tube 21 is telescopingly received within the first tube 20 and the first tube 20 is in electrical communication with the internally threaded adapter socket 15, as well as the second tube 21, wherein the second tube 21 is in electrical communication with the internally threaded outer socket cylindrical wall 29. The further socket member 19 is formed with a polymeric covering sheath in surrounding relationship relative to the outer socket floor 25 and the internally threaded socket cylindrical wall 29 as illustrated. Further, a collapsible and extensible bellows 22 is arranged coextensively between the adapter head 13 and the further socket member 19 to accommodate the extension in collapsing of the first tube relative to the second tube. If desired, a switch member 26 may be provided to provide for selective illumination of an individual bulb mounted within the further socket members 19, such as illustrated in FIG. 7.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily aperient and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A light bulb adapter apparatus in combination with a standard light bulb socket, including an internally threaded first bore of a first diameter, wherein the apparatus comprises, an adapter externally threaded cylindrical base defined by a base diameter equal to the first diameter, and wherein the adapter externally threaded cylindrical base includes an adapter internally threaded socket mounted to an upper terminal end of the adapter base and coaxially aligned therewith, wherein the adapter internally threaded socket is defined by a second diameter less than the first diameter, and wherein the adapter base and the adapter socket are formed of a unitary integral construction, and the adapter socket includes an adapter head circumferentially coextensively mounted exteriorly of the adapter socket, and wherein the adapter head includes an adapter head upper terminal end coincident with an upper terminal end of the adapter socket, and the adapter head includes an adapter head lower terminal end defining a skirt, and the adapter base includes a cylindrical groove positioned within an upper terminal end of the base receiving the skirt, and the adapter head further includes a flange extending radially exteriorly beyond the adapter base upper terminal end defining a torroidal abutment surface for abutment of an upper terminal end of the standard light bulb socket, and at least one further socket member mounted to the adapter socket, the further socket member formed with an internally threaded socket cylindrical wall and a further socket floor, and a further socket post positioned coaxially of the further socket floor, and a central inner conductor rod extending coextensively of the adapter base and the adapter socket, with the adapter base including a polymeric adapter base floor, and the adapter socket including a polymeric adapter socket floor, with the central conductor rod extending coaxially of the base floor and the adapter socket floor, and an electrical conductor wire in electrical communication between the central inner conductor rod and the further socket post.

2. An apparatus as set forth in claim 1 including a first metallic mounting tube in electrical communication with the adapter socket, and the first tube telescopingly receiving a second tube, the second tube in electrical communication with the internally threaded outer socket cylindrical wall, and the electrical connector wire directed through the first tube and the second tube, and an extensible and collapsible bellows mounted coextensively between the adapter socket and the further socket member accommodating sliding adjustment of the second mounting tube within the first mounting tube.

* * * * *